United States Patent [19]

Hayes

[11] 4,294,144

[45] Oct. 13, 1981

[54] APPARATUS FOR CUTTING SHEET MOLDING COMPOUND

[75] Inventor: Richard H. Hayes, Tallmadge, Ohio

[73] Assignee: Eagle-Picher Industries, Inc., Cincinnati, Ohio

[21] Appl. No.: 91,968

[22] Filed: Nov. 7, 1979

[51] Int. Cl.[3] ..... B26D 5/02; B26D 9/00

[52] U.S. Cl. ..... 83/71; 83/208; 83/212.1; 83/271; 83/408; 83/435.2

[58] Field of Search ..... 83/71, 208, 212.1, 271, 83/368, 408, 435.2; 156/152; 242/56.6, 55.1

[56] References Cited

U.S. PATENT DOCUMENTS

| | | | |
|---|---|---|---|
| 2,303,346 | 12/1942 | Flood | 156/152 |
| 2,681,702 | 6/1954 | Kuenn et al. | 242/56.6 X |
| 2,733,766 | 2/1956 | Wikle | 83/271 |
| 3,574,026 | 4/1971 | Kucheck | 156/152 |
| 3,620,114 | 11/1971 | Chudyk | 83/408 X |
| 3,657,952 | 4/1972 | Brockbank et al. | 83/408 X |
| 4,111,121 | 9/1978 | Borum | 156/152 X |
| 4,207,787 | 6/1980 | Lewallyn | 83/408 X |

*Primary Examiner*—Frank T. Yost

*Attorney, Agent, or Firm*—Wood, Herron & Evans

[57] ABSTRACT

Apparatus for cutting sheet molding compound in which the compound is sandwiched between two liner sheets and fed from a letoff roll onto a conveyor. The compound is conveyed past longitudinal slitters and a transverse cutting knife which cut the compound into rectangular segments of preselected size. Before a sheet reaches the area of the cutting operation, the upper liner is removed. At the area of the transverse cutting, the lower liner is diverted from the sheet compound to pass under an anvil against which the transverse cutting mechanism operates. The lower liner is then passed upwardly to return to a position underneath the sheet compound in order to support the sheet compound on the liner as it passes along the conveyor where it is picked off by the operator.

4 Claims, 2 Drawing Figures

APPARATUS FOR CUTTING SHEET MOLDING COMPOUND

Figures 1, 2:
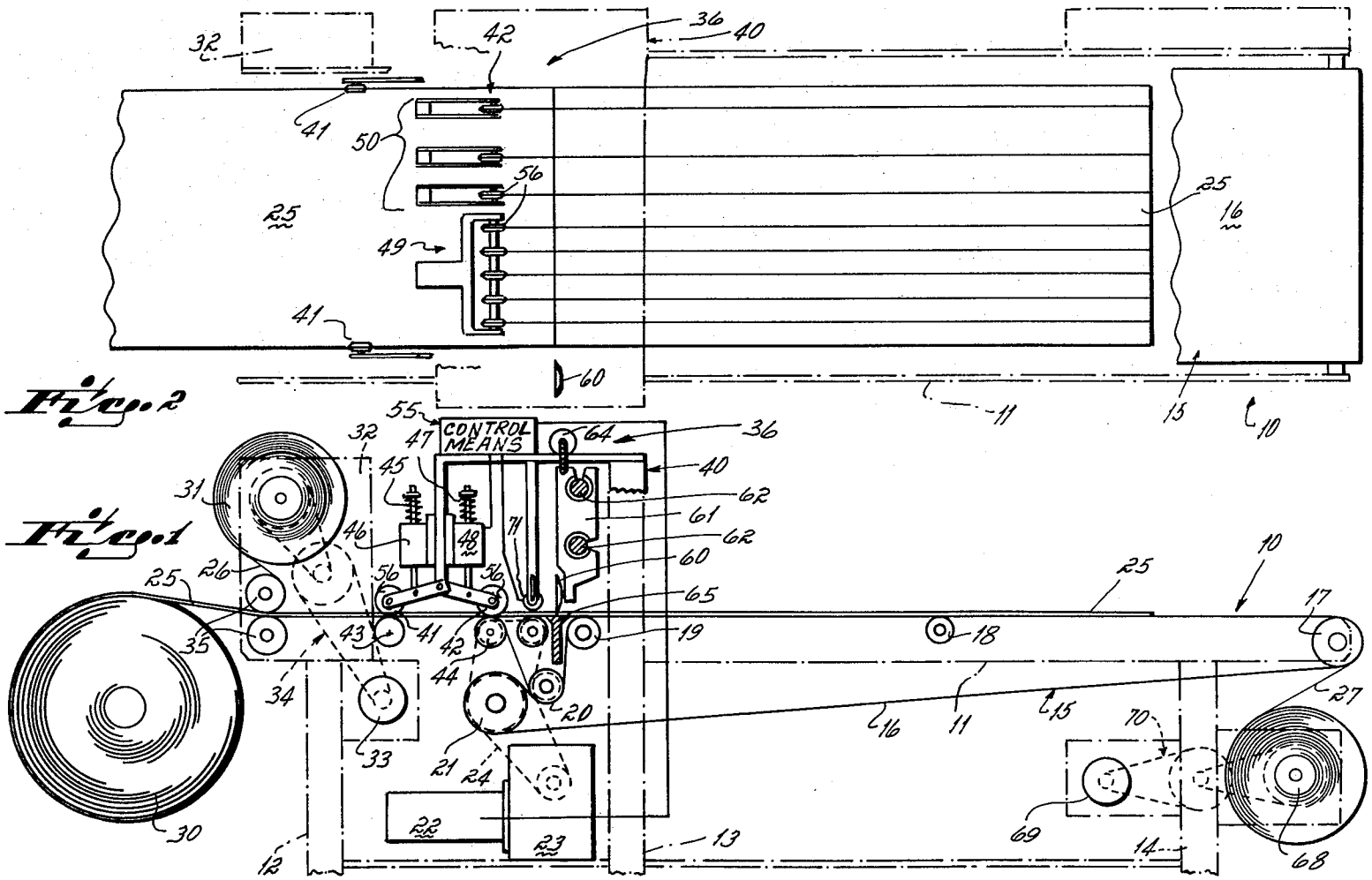

This invention relates to automatic machines for cutting sheet moldable compound into strips of preselected size.

In the art of molding large plastic parts, molding apparatus is employed wherein male and female dies or platens receive a charge of uncured plastic. The plastic placed in the mold will flow to some extent, but not a great deal. Therefore, as the press opens the operator must carefully place a charge of uncured plastic into the mold by piling up strips of various sizes in a quantity sufficient to make the product and in an orientation necessary to completely fill the space between the two mold halves without requiring substantial flow of the compound.

The present practice of making the charge is to feed the uncured plastic compound in sheet form through a slitter which cuts the plastic into longitudinal strips. The operator takes a guess at how much is needed and cuts off a strip transversely with a hand knife. These strips the operator piles into the mold half in order to make the charge.

Obviously the foregoing method is somewhat inexact and wasteful. If not enough compound is placed in the mold, the bad part will be formed. If too much compound is placed in the mold, there is a waste of compound. The operation is necessarily slow because of the judgment required as the operator cuts off each piece.

It has been an objective of the present invention to provide automatic machinery for cutting precisely sized strips of molding compound from a sheet so as to eliminate the judgment required of the operator and to provide for a more exact charging of the molding press.

The objective of the invention is attained by providing a conveyor having selectively positionable slitting knives and a transverse cutting knife for cutting precise strips which are formed on a sheet of compound passing along the conveyor. The conveyor has means for determining the length of compound which has passed the cutting knife so that the conveyor can be stopped and the transverse cutting knife operated in order to cut precise lengths of compound.

The several features of the invention will become more readily apparent from the following detailed description taken in conjunction with the accompanying drawings in which:

FIG. 1 is a diagrammatic side elevational view of the apparatus of the present invention; and FIG. 2 is a top plan view of the apparatus of the present invention.

The apparatus of the present invention includes a base 10 having at least one horizontal beam 11 and three pairs of vertical posts 12, 13 and 14. A conveyor 15 is mounted on the base and consists of an endless belt 16 passing around idler pulleys 17, 18, 19 and 20 and a drive pulley 21. The drive pulley 21 is driven from a one horsepower motor 22 through a gear box 23 and a chain drive 24.

Sheet moldable compound, indicated at 25, is a plastic mix in sheet form carried between an upper liner 26 and a lower liner 27. The compound is wound on a letoff roll 30 mounted at the upstream end of the machine 10 and adapted to be fed onto the conveyor 15. An upper liner windup roll 31 is mounted on a frame 32 immediately downstream of the letoff roll 30 and is driven by a one-half horsepower motor 33 through a chain and pulley transmission 34.

The sheet of compound passes between pressure rolls 35 into a slitting and cutting section 36. Upstream of the slitting and cutting section 36, the upper liner passes around the upper pressure roll 35 and onto the windup roll 31.

The cutting section 36 includes a frame 40 carrying edge slitters 41 and automatic slitters 42. The edge slitters press against a rubber-covered roll 43. The automatic slitter press against a rubber-covered roll 44. The edge slitters are urged by springs 45 against the backup roll 43 and air pistons and cylinders 46 are mounted on the rolls to raise the rolls out of engagement with the backup roll.

Similarly, the automatic slitters are spring-urged against the backup roll 44 by springs 47 and have pistons and cylinders 48 for raising the slitters.

As indicated in the top plan view of FIG. 2, the slitters may be ganged together as shown at 49, or the slitters may be individually operated as indicated by the group of slitters 50. Each slitter or group of slitters has its own piston and cylinder combination as well as an air valve effective to operate the respective slitter or combination of slitters, respectively. The air valves and, consequently, the pistons and cylinders are operatec by a control means 55 in a manner to be described below.

Each slitter has a circular knife 56 which is fixed in its mounting but can be rotated periodically as the edge gets dull.

A transverse knife 60 is rotatably mounted on a bracket 61 which is mounted on transverse rods 62 for movement transversely across the apparatus. A double-acting cable cylinder 64 is mounted on the frame 40 and is connected to the bracket 61 to drive the bracket 61 and its knife 60 across the apparatus. The double-acting cable cylinder 64 is also connected to the control means 55.

An anvil 65 is mounted below the knife 60 and the knife 60 rolls across the anvil 65 in order to provide a rolling shear which cuts the compound transversely.

As shown in FIG. 1, the lower liner 27 is passed below the anvil 65 around idler pulley 20, separating it from the compound, and is then passed around idler roll 19 where it rejoins the compound. Thus, the lower liner is not cut transversely when the compound is cut transversely, but is returned immediately to a supporting relationship to the compound as the compound is pulled along the conveyor belt 16. The liner thus provides support for the compound at all times except the brief time when it is transversely cut and further protects the belt 16 and other equipment from the compound. The liner has a slippery surface from which the compound is more readily peeled than from the surface of the conveyor 15.

A lower liner windup roll 68 is located at the downstream end of the conveyor 15 and is driven by a one-half horsepower motor 69 through a chain and sprocket transmission 70.

A tachometer roll 71 pressing the sheet of compound against a pressure roll 72 measures the length of travel of the compound through the cutting section 36. The output from the tachometer is fed into the control means 55 for the overall control of the cutting of strips of preselected size as will be described below.

The control means 55 is programmable to introduce differing sequences of operations into the longitudinal slitters 42 and transverse knife 60. For example, the transverse knife might be programmed to cut strips every four inches and then every six inches. Similarly, certain slitters might be continuously in cutting engagement with the compound, whereas other slitters might be selectively raised and lowered in order to vary the dimensions of the rectangular pieces of compound which are cut from the sheet. In this way, the apparatus can be programmed to cut a wide variety of sizes of strips, all of which have been previously calculated to be required to properly fill a press for a specific molding operation.

Further, the program can be split so as to cut a preselected group of differing sized strips for one molding operation and thereafter cut a completely different pattern for another molding operation.

It is contemplated that the apparatus of the present invention would feed at least two presses, one located along each side of the apparatus. More than two presses, however, could be fed by the present apparatus. If one press with one pattern operated twice as fast as a second press with a second pattern, the control means could be programmed to turn out twice as many patterns of strips for the first press as for the second press.

It is also contemplated that the apparatus of the present invention might be employed to feed presses at distant locations. In that event, the operators would not strip compound from the apparatus as it passes along the upper flight of the conveyor belt 16. Rather, the compound and roll liner would simply be rolled onto a roll similar to the roll liner takeup roll 68 and thereafter transported to the area where the pieces are located.

Having described my invention, I claim:

1. Apparatus for cutting sheet molding compound carried on a liner comprising, a conveyor for carrying compound and liner, a plurality of transversely adjustable slitting knives engageable with said compound to form longitudinal slits in said compound to form strips of selectively variable width, a transversely movable knife engageable with said compound to cut said strips into preselected lengths, means for separating said liner from said compound upstream of said transverse knife and returning it to said compound downstream of said knife, anvil means against which said knife presses said compound to cut the same, said anvil means being located between said liner and compound, means for detecting the longitudinal distance of movement of said compound, and means for automatically operating said knife after a preselected length of compound passes under it.

2. Apparatus as in claim 1 further comprising a letoff roll upstream of said slitters and knife for supplying compound between top and bottom liners, a windup roll between said letoff roll and said slitters and knife for removal of said top liner, a windup roll for said bottom liner and located a substantial distance downstream of said slitters and knife so as to provide a support for said compound after it has been slit and tranversely cut until removal by an operator.

3. Apparatus as in claim 1 in which said anvil means comprises a hard anvil on which said knife rolls for a rolling shear to cut said compound transversely.

4. Apparatus as in claim 1 further comprising control means for selectively operating selected slitting knives to cut strips of compound of varying widths and lengths.

* * * * *